US009677343B2

(12) United States Patent
Hall et al.

(10) Patent No.: US 9,677,343 B2
(45) Date of Patent: Jun. 13, 2017

(54) TRACKING SHEARING CUTTERS ON A FIXED BLADED DRILL BIT WITH POINTED CUTTING ELEMENTS

(71) Applicant: Schlumberger Technology Corporation, Houston, TX (US)

(72) Inventors: David R. Hall, Provo, UT (US); Ronald B. Crockett, Payson, UT (US); Marcus Skeem, Provo, UT (US); Francis Leany, Salem, UT (US); Casey Webb, Provo, UT (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/492,893

(22) Filed: Sep. 22, 2014

(65) Prior Publication Data

US 2015/0027786 A1 Jan. 29, 2015

Related U.S. Application Data

(63) Continuation of application No. 12/766,555, filed on Apr. 23, 2010, now Pat. No. 8,839,888.

(51) Int. Cl.

| | |
|---|---|
| ***E21B 10/43*** | (2006.01) |
| ***E21B 10/42*** | (2006.01) |
| ***E21B 10/55*** | (2006.01) |

(52) U.S. Cl.

CPC ..... *E21B 10/43* (2013.01); *E21B 10/42* (2013.01); *E21B 10/55* (2013.01); *E21B 2010/425* (2013.01)

(58) Field of Classification Search

CPC ..... E21B 10/55; E21B 10/43; E21B 10/42; E21B 10/52; E21B 2010/425

USPC ..... 175/428, 430, 431

See application file for complete search history.

(56) References Cited

U.S. PATENT DOCUMENTS

| | | | |
|---|---|---|---|
| 465,103 | A | 12/1891 | Wegner |
| 616,118 | A | 12/1898 | Kunhe |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,387,733 | A | 8/1921 | Midgett |
| 1,460,671 | A | 7/1923 | Hebsacker |
| 1,544,757 | A | 7/1925 | Hufford et al. |
| 1,821,474 | A | 9/1931 | Mercer |
| 1,879,177 | A | 9/1932 | Gault |
| 2,054,255 | A | 9/1936 | Howard |
| 2,064,255 | A | 12/1936 | Garfield |
| 2,169,223 | A | 8/1939 | Christian |

(Continued)

*Primary Examiner* — Michael Wills, III

(57) ABSTRACT

A fixed bladed drill bit has a working face that includes a plurality of blades converging at a center of the working face and diverging towards a gauge of the bit, each blade having a leading face and a trailing face, and at least one row of cutting elements disposed on at least one of the plurality of blades proximate to the leading face of the blade, where the row of cutting elements includes at least one pointed cutting element having a cutting end with a rounded apex and at least one shearing cutter. The at least one shearing cutter includes a first shearing cutter positioned proximate to a periphery of the working face.

17 Claims, 9 Drawing Sheets

(56) References Cited

U.S. PATENT DOCUMENTS

| | | | |
|---|---|---|---|
| 2,218,130 | A | 10/1940 | Court |
| 2,320,136 | A | 5/1943 | Kammerer |
| 2,466,991 | A | 4/1949 | Kammerer |
| 2,540,464 | A | 2/1951 | Stokes |
| 2,544,036 | A | 3/1951 | Kammerer |
| 2,755,071 | A | 7/1956 | Kammerer |
| 2,776,819 | A | 1/1957 | Brown |
| 2,819,043 | A | 1/1958 | Henderson |
| 2,838,284 | A | 6/1958 | Austin |
| 2,894,722 | A | 7/1959 | Buttolph |
| 2,901,223 | A | 8/1959 | Scott |
| 2,963,102 | A | 12/1960 | Smith |
| 3,135,341 | A | 6/1964 | Ritter |
| 3,294,186 | A | 12/1966 | Buell |
| 3,301,339 | A | 1/1967 | Pennebaker, Jr. |
| 3,379,264 | A | 4/1968 | Cox |
| 3,429,390 | A | 2/1969 | Bennett |
| 3,493,165 | A | 2/1970 | Schonfeld |
| 3,583,504 | A | 6/1971 | Aalund |
| 3,764,493 | A | 10/1973 | Rosar |
| 3,821,993 | A | 7/1974 | Kniff |
| 3,955,635 | A | 5/1976 | Skidmore |
| 3,960,223 | A | 6/1976 | Kleine |
| 4,081,042 | A | 3/1978 | Johnson et al. |
| 4,096,917 | A | 6/1978 | Harris |
| 4,106,577 | A | 8/1978 | Summers |
| 4,109,737 | A | 8/1978 | Bovenkerk |
| 4,176,723 | A | 12/1979 | Arceneaux |
| 4,253,533 | A | 3/1981 | Baker, III |
| 4,280,573 | A | 7/1981 | Sudnishnikov et al. |
| 4,304,312 | A | 12/1981 | Larsson |
| 4,307,786 | A | 12/1981 | Evans |
| 4,397,361 | A | 8/1983 | Langford, Jr. |
| 4,416,339 | A | 11/1983 | Baker et al. |
| 4,445,580 | A | 5/1984 | Sahley |
| 4,448,269 | A | 5/1984 | Ishikawa et al. |
| 4,499,795 | A | 2/1985 | Radtke |
| 4,531,592 | A | 7/1985 | Hayatdavoudi |
| 4,535,853 | A | 8/1985 | Ippolito et al. |
| 4,538,691 | A | 9/1985 | Dennis |
| 4,545,441 | A | 10/1985 | Williamson |
| 4,566,545 | A | 1/1986 | Story et al. |
| 4,574,895 | A | 3/1986 | Dolezal et al. |
| 4,640,374 | A | 2/1987 | Dennis |
| 4,852,672 | A | 8/1989 | Behrens |
| 4,889,017 | A | 12/1989 | Fuller et al. |
| 4,932,484 | A | 6/1990 | Warren et al. |
| 4,962,822 | A | 10/1990 | Pascale |
| 4,981,184 | A | 1/1991 | Knowlton et al. |
| 5,009,273 | A | 4/1991 | Grabinski |
| 5,027,914 | A | 7/1991 | Wilson |
| 5,038,873 | A | 8/1991 | Jurgens |
| 5,119,892 | A | 6/1992 | Clegg et al. |
| 5,141,063 | A | 8/1992 | Quesenbury |
| 5,145,017 | A | 9/1992 | Holster et al. |
| 5,186,268 | A | 2/1993 | Clegg |
| 5,222,566 | A | 6/1993 | Taylor et al. |
| 5,238,075 | A | 8/1993 | Keith et al. |
| 5,255,749 | A | 10/1993 | Bumpurs et al. |
| 5,265,682 | A | 11/1993 | Russell et al. |
| 5,265,685 | A | 11/1993 | Keith et al. |
| 5,346,025 | A | 9/1994 | Keith et al. |
| 5,361,859 | A | 11/1994 | Tibbitts |
| 5,410,303 | A | 4/1995 | Comeau et al. |
| 5,417,292 | A | 5/1995 | Polakoff |
| 5,423,389 | A | 6/1995 | Warren et al. |
| 5,507,357 | A | 4/1996 | Hult et al. |
| 5,549,171 | A | 8/1996 | Mensa-Wilmot et al. |
| 5,551,522 | A | 9/1996 | Keith et al. |
| 5,560,440 | A | 10/1996 | Tibbitts |
| 5,568,838 | A | 10/1996 | Struthers et al. |
| 5,582,261 | A | 12/1996 | Keith et al. |
| 5,655,614 | A | 8/1997 | Azar |
| 5,678,644 | A | 10/1997 | Fielder |
| 5,732,784 | A | 3/1998 | Nelson |
| 5,794,728 | A | 8/1998 | Palmberg |
| 5,848,657 | A | 12/1998 | Flood et al. |
| 5,896,938 | A | 4/1999 | Moeny et al. |
| 5,947,215 | A | 9/1999 | Lundell |
| 5,950,743 | A | 9/1999 | Cox |
| 5,957,223 | A | 9/1999 | Doster et al. |
| 5,957,225 | A | 9/1999 | Sinor |
| 5,967,247 | A | 10/1999 | Pessier |
| 5,979,571 | A | 11/1999 | Scott et al. |
| 5,992,547 | A | 11/1999 | Caraway et al. |
| 5,992,548 | A | 11/1999 | Silva et al. |
| 6,021,859 | A | 2/2000 | Tibbitts et al. |
| 6,039,131 | A | 3/2000 | Beaton |
| 6,131,675 | A | 10/2000 | Anderson |
| 6,150,822 | A | 11/2000 | Hong et al. |
| 6,164,394 | A | 12/2000 | Mensa-Wilmot et al. |
| 6,186,251 | B1 | 2/2001 | Butcher |
| 6,202,761 | B1 | 3/2001 | Forney |
| 6,213,226 | B1 | 4/2001 | Eppink et al. |
| 6,223,824 | B1 | 5/2001 | Moyes |
| 6,269,893 | B1 | 8/2001 | Beaton et al. |
| 6,332,503 | B1 | 12/2001 | Pessier et al. |
| 6,340,064 | B2 | 1/2002 | Fielder et al. |
| 6,364,034 | B1 | 4/2002 | Schoeffler |
| 6,394,200 | B1 | 5/2002 | Watson et al. |
| 6,408,959 | B2 | 6/2002 | Bertagnolli et al. |
| 6,439,326 | B1 | 8/2002 | Huang et al. |
| 6,474,425 | B1 | 11/2002 | Truax et al. |
| 6,484,825 | B2 * | 11/2002 | Watson ..... E21B 10/43 175/374 |
| 6,484,826 | B1 | 11/2002 | Anderson et al. |
| 6,510,906 | B1 | 1/2003 | Richert et al. |
| 6,513,606 | B1 | 2/2003 | Krueger |
| 6,533,050 | B2 | 3/2003 | Molloy |
| 6,564,886 | B1 | 5/2003 | Mensa-Wilmot et al. |
| 6,594,881 | B2 | 7/2003 | Tibbitts |
| 6,601,454 | B1 | 8/2003 | Botnan |
| 6,622,803 | B2 | 9/2003 | Harvey et al. |
| 6,668,949 | B1 | 12/2003 | Rives |
| 6,672,406 | B2 | 1/2004 | Beuershausen |
| 6,729,420 | B2 | 5/2004 | Mensa-Wilmot |
| 6,732,817 | B2 | 5/2004 | Dewey et al. |
| 6,822,579 | B2 | 11/2004 | Goswami et al. |
| 6,929,076 | B2 | 8/2005 | Fanuel et al. |
| 6,953,096 | B2 | 10/2005 | Gledhill et al. |
| 7,546,888 | B2 * | 6/2009 | Cruz ..... 175/415 |
| 2001/0004946 | A1 | 6/2001 | Jensen |
| 2003/0213621 | A1 | 11/2003 | Britten et al. |
| 2004/0238221 | A1 | 12/2004 | Runia et al. |
| 2004/0256155 | A1 | 12/2004 | Kriesels et al. |
| 2006/0196699 | A1 | 9/2006 | Estes et al. |
| 2011/0155472 | A1 * | 6/2011 | Lyons ..... E21B 10/55 175/331 |

* cited by examiner

TRACKING SHEARING CUTTERS ON A FIXED BLADED DRILL BIT WITH POINTED CUTTING ELEMENTS

CROSS-REFERENCE TO RELATED APPLICATIONS

This application is a continuation of U.S. patent application Ser. No. 12/766,555, filed on Apr. 23, 2010, which is herein incorporated by reference in its entirety.

BACKGROUND OF THE INVENTION

The present invention relates to the field of drill bits used in drilling through subterranean formation. More particularly, this invention is concerned with the arrangement of the cutter elements that are mounted on the face of the drill bit's face.

U.S. Pat. No. 5,265,685 to Keith, which is herein incorporated by reference for all that it contains, discloses a fixed cutting element drill bit provided with primary cutting elements which are spaced radially from each other across the face of the bit. During drilling, the gap between the cutting elements causes a ridge to be formed in the bottom of the well and the apex of the ridge is removed before reaching the face of the bit. In one form of the invention, the apex is broken off by utilization of the sides of the supports for the primary cutting elements.

U.S. Pat. No. 5,551,522 to Keith, which is herein incorporated by reference for all that it contains, discloses a fixed cutter drill bit including a cutting structure having radially-spaced sets of cutter elements. The cutter element sets preferably overlap in rotated profile and include at least one low profile cutter element and at least two high profile elements. The low profile element is mounted so as to have a relatively low exposure height. The high profile elements are mounted at exposure heights that are greater than the exposure height of the low profile element, and are radially spaced from the low profile element on the bit face. The high profile elements may be mounted at the same radial position but at differing exposure heights, or may be mounted at the same exposure heights but at different radial positions relative to the bit axis. Providing this arrangement of low and high profile cutter elements tends to increase the bit's ability to resist vibration and provides an aggressive cutting structure, even after significant wear has occurred.

U.S. Pat. No. 5,549,171 to Wilmot, which is herein incorporated by reference for all that it contains, discloses a fixed cutter drill bit including sets of cutter elements mounted on the bit face. Each set includes at least two cutters mounted on different blades at generally the same radial position with reset to the bit axis but having differing degrees of backrake. The cutter elements of a set may be mounted having their cutting faces out-of-profile, such that certain elements in the set are exposed to the formation material to a greater extent than other cutter elements in the same set. The cutter elements in a set may have cutting faces and profiles that are identical, or they may vary in size or shape or both. The bit exhibits increased stability and provides substantial improvement in ROP without requiring excessive WOB.

Examples of prior art drill bits are disclosed in U.S. Pat. No. 4,545,441 to Williamson, U.S. Pat. No. 4,981,184 to Knowlton, U.S. Pat. No. 6,164,394 to Wilmot, U.S. Pat. No. 4,932,484 to Warren, U.S. Pat. No. 5,582,261 to Keith, which are all herein incorporated by reference for all that they contain.

BRIEF SUMMARY OF THE INVENTION

In one aspect of the invention, a fixed bladed drill bit comprises a working surface comprising a plurality of blades converging at a center of the working surface and diverging towards a gauge of the bit. Each blade comprises a plurality of pointed cutting elements and another plurality of shearing cutters. The plurality of shearing cutters comprises a first shearing cutter. The first shearing cutter on each blade tracks the first shearing cutters on other blades along a common circular cutting path.

The first shearing cutter may be positioned proximate to a periphery of the working surface. The periphery of the working surface of each blade comprises either a shearing cutter or a pointed cutting element. The first shearing cutter may be positioned intermediate the periphery and the center of the working surface of the blade. The first shearing cutter in each blade may overlap each other in rotated profile. Each blade may comprise a plurality of shearing cutters intermediate the periphery and the center of the working surface inclusively.

In some embodiments, the plurality of shearing cutters tracks a plurality of circular cutting paths. The first shearing cutter may be mounted such that its cutting profile is more exposed to the formation material than the cutting profile of the plurality of pointed cutting elements. The pluralities of pointed cutting elements may comprise the characteristic of inducing intermittent fractures in the formation. A portion of the first shearing cutter may be aligned behind the pointed cutting elements in rotated profile. The plurality of pointed cutting elements may be aligned in a uniform manner such that a portion of each cutting element overlaps a portion of an adjacent cutting element in a rotated profile.

The pointed cutting elements and the shearing cutters may create grooves and ridges in the formation while drilling down hole. The common circular cutting path may comprise a groove wider than grooves created by the pointed cutting elements. The first shearing cutters may cut the formation both in the axial and radial direction. The pointed cutting elements are exposed at varying angles on the working surface. The pointed cutting elements may be exposed at the same height above the blade profile. The cutting elements may comprise a superhard material bonded to a cemented metal carbide substrate at a non-planar interface.

DETAILED DESCRIPTION OF THE INVENTION AND THE PREFERRED EMBODIMENT

Figure 1:
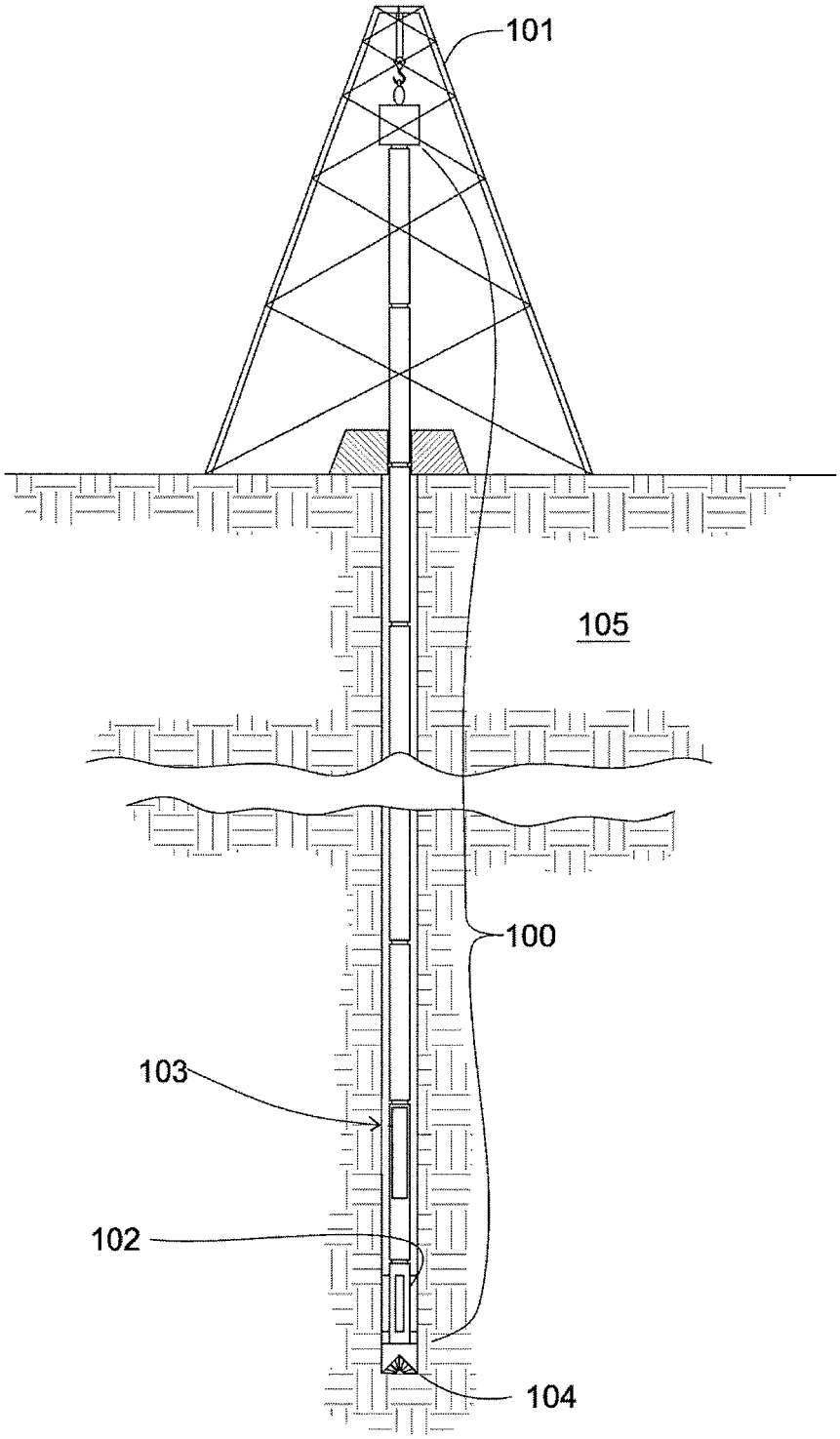
FIG. 1 is a perspective diagram of an embodiment of a drill string suspended in a bore hole.

Referring now to the figures, FIG. 1 is a cross-sectional diagram of an embodiment of a drill string 100 suspended within a bore hole by a derrick 101. A bottom-hole assembly 102 is located at the bottom of a bore hole 103 and comprises a bit 104 and a stabilizer assembly. As the drill bit 104 rotates down hole, the drill string 100 advances farther into the earth. The drill string 100 may penetrate soft or hard subterranean formations 105.

Figure 2A:
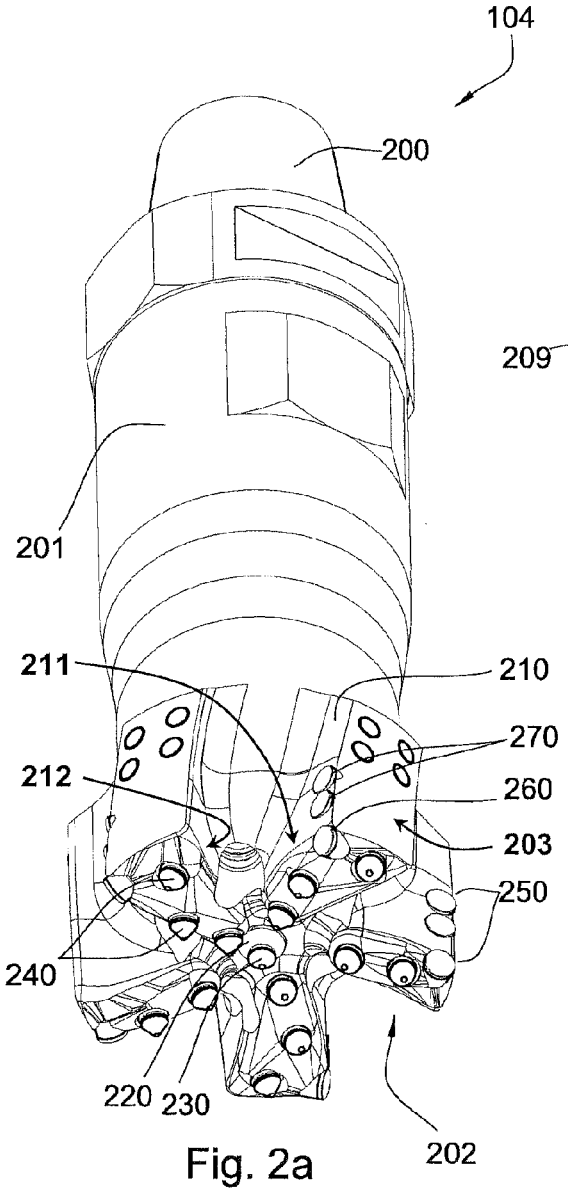
FIG. 2*a* is a perspective diagram of an embodiment of a rotary drag bit.
Figure 2B:
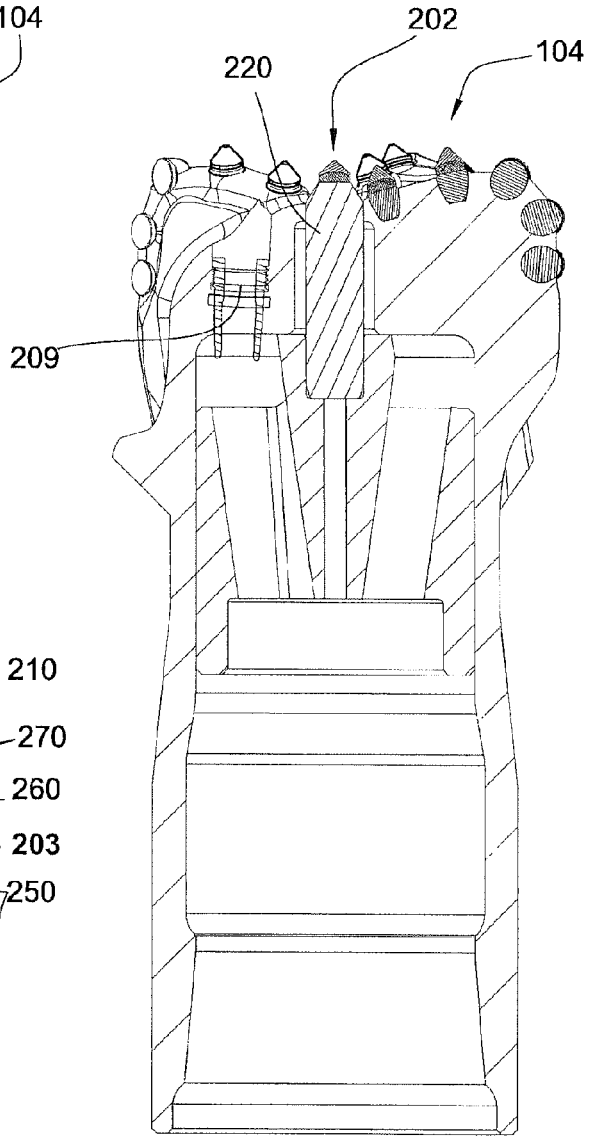
FIG. 2*b* is a cross-sectional diagram of an embodiment of a rotary drag bit.

FIGS. 2*a* and 2*b* disclose a drill bit 104 with a shank 200 adapted for connection to the drill string 100. In some embodiments coiled tubing or other types of tool string components may be used. The drill bit 104 may be used for deep oil and gas drilling, geothermal drilling, mining, exploration, on and off-shore drilling, directional drilling, water well drilling and combinations thereof. The bit body 201 is attached to the shank 200 and comprises an end which forms a working surface 202. Several blades 210 extend outwardly from the bit body 201, each of which has a leading face 211 and a trailing face 212. Further, each blade 210 may comprise a plurality of cutting elements, which may include both pointed cutting elements 240 and shearing cutters 250. The plurality of shearing cutters 250 may comprise a first shearing cutter 260 positioned proximate to a periphery of the working surface 202 of the drill bit 104. A plurality of cutting elements may be formed in a row extending along each blade 210, proximate the leading face 211 of the blade 210, wherein the row of cutting elements includes at least one pointed cutting element 240 and at least a first shearing cutter 260. The plurality of blades 210 converge towards a center of the working surface 202 and diverge towards a gauge 203 portion of the bit 104. The center of the working surface 202 may comprise an indenting member 220 with a hard insert 230. The hard insert 230 may comprise the same or similar geometry and material as the pointed cutting elements on the blades 210. The gauge 203 portion of the bit 104 may also comprise a plurality of shearing cutters 270. The cutter elements may comprise a superhard material such as sintered polycrystalline diamond processed in a high pressure high temperature press bonded to a cemented metal carbide substrate at a non-planar interface.

FIG. 2*b* is a cross-sectional diagram of an embodiment of the drill bit. A plurality of nozzles 209 are fitted into recesses formed in the working surface 202 between the blades. Each nozzle 209 may be oriented such that a jet of drilling mud ejected from the nozzles 209 engages the formation before or after the cutting elements 230. The jets of drilling mud may also be used to clean cuttings away from drill bit 104. In some embodiments, the jets may be used to create a sucking effect to remove drill bit cuttings adjacent the cutting inserts 230 or the indenting member by creating a low pressure region within their vicinities.

The indenting member may be press fitted or brazed into the bit body. Preferably, the indenting member is made of a hard metal material, such as a cemented metal carbide. The hard insert affixed to the distal end of the indenting member may protrude more than the closest pointed cutting elements of the blades.

Figure 3A:
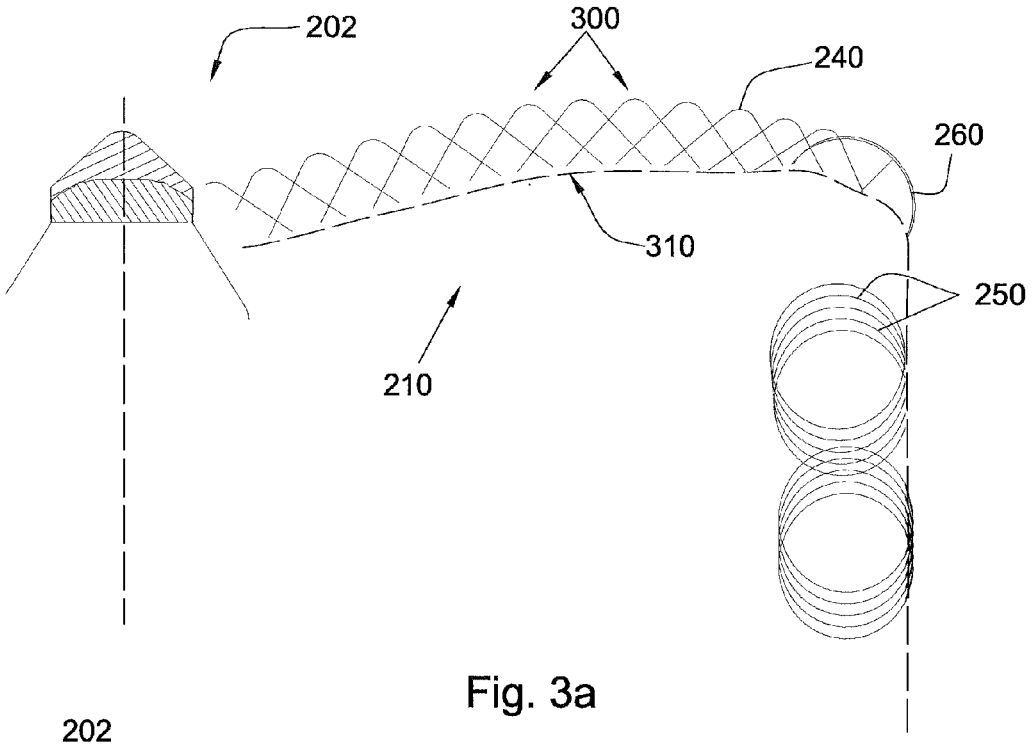
FIG. 3*a* is a diagram of an embodiment of a blade cutting element profile.

FIG. 3*a* discloses a rotated profile 310 of the drill bit blades 210 superimposed on each. Cutter profiles 300 substantially cover the blade profile 310 between a central portion of the working surface 202 and the gauge portion of the blade profile 310. A portion of each pointed cutting element 240 may overlap a portion of adjacent cutting element on a different blade in the rotated profile. The first shearing cutters 260 on each blade 210 may overlap each other completely or in other words, the first shear cutters share a common cutter path when the drill bit rotates along a straight trajectory.

Surprisingly, the first shearing cutters 260 positioned proximate to the periphery of the working surface 202 of the drill bit 104 have a different cutting mechanism than the traditional shear cutters positioned anywhere on the blades resulting in prolonged life for both the pointed cutting elements 240 and shearing cutters 250. A single first shearing cutter 260 may replace at least 2-3 pointed cutting elements 240 at the working surface's periphery. This reduction of cutting elements may help reduce the application's ideal weight on bit ("WOB"), which eventually reduces the amount of energy required for the application. Furthermore, positioning of the first shear cutters 260 proximate to the periphery of the working surface 202 of the drill bit 104 may allow the drill bit 104 to cut the formation at a higher rate of penetration, thereby saving time. The shearing cutters 270 on the gauge portion of the drill bit 104 may overlap each other partially. The shearing cutters 270 protect the gauge portion of the drill bit 104 against any hard formations during the operation.

Another surprising benefit of this unique arrangement of cutting elements is the bit's stability. A major reason for drill failure is uncontrolled bit vibrations, which break the cutters, even diamond enhanced cutters, at the periphery of the prior art drill bits. In this application, however, the tracking shear cutters at the bit's periphery increased the stability of the bit. The combined shear cutters' comparatively longer perimeters along the common cutting path are believed to reduce the bit's lateral vibration. The pointed cutting elements have thinner cross sectional cutting surfaces, thus, reduced lateral loads may increase their life. Preferably however, the pointed cutting elements are shaped so that their cutting surfaces are well buttressed for more vertically oriented loads. The pointed cutting elements also tend to induce controlled vertical vibrations in the bit, which are believed to be beneficial because the formation is additionally degraded through fatigue. Thus, this arrangement of shearing cutters is believed to synergistically improve the pointed cutting elements' performance.

Figure 3B:
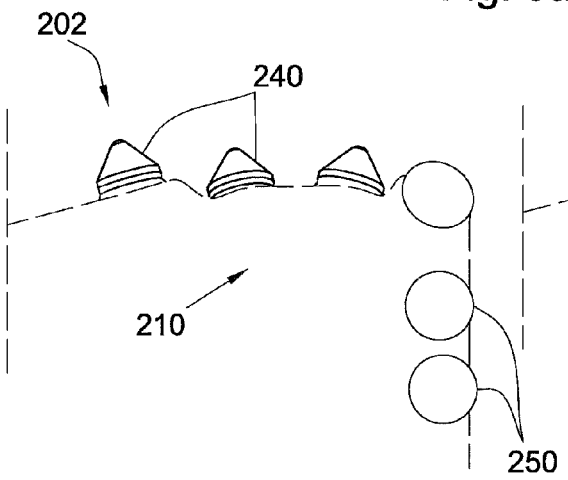
FIG. 3*b* is a diagram of another embodiment of a blade cutting element profile.
Figure 3C:
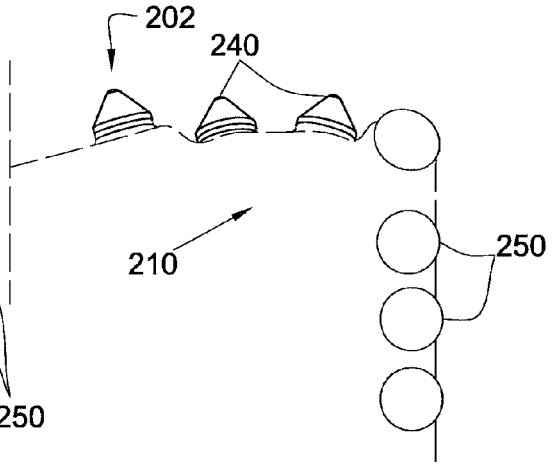
FIG. 3*c* is a diagram of another embodiment of a blade cutting element profile.

FIGS. 3*b* and 3*c* disclose an embodiment of cutting elements in a single blade 210. Each blade 210 may comprise the same or different number of pointed cutting elements 240 and/or shearing cutters 250 on each blade. The pointed cutting elements 240 may be exposed to the formation at varying angles or heights. In some embodiments, the first shearing cutter 260 and the pointed cutting elements 240 may be arranged in a linear or curved profile on each blade 210.

Figure 4:
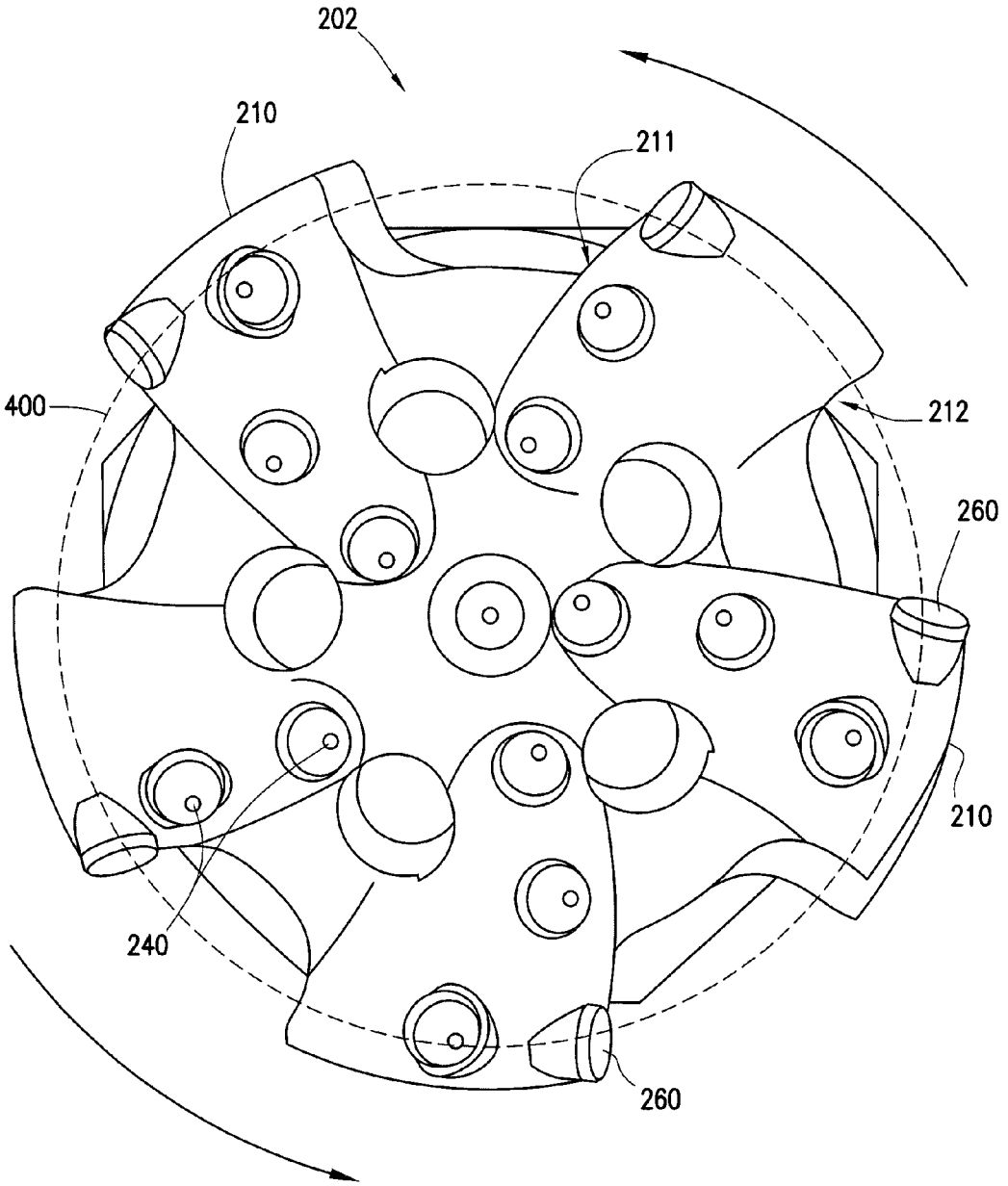
FIG. 4 is an orthogonal diagram of an embodiment of a working surface of a rotary drag bit.

Referring to FIG. 4, discloses how the first shearing cutter 260 on each blade 210 positioned proximate to the periphery of the working surface 202 track the first shearing cutters 260 on other blades along a common circular cutting path 400. Such circular cutting path 400 formed by the first shearing cutters 260 is believed to minimize the wobbling of the drill bit 104 during operation, thereby providing higher stability to the drill bit 104.

Figure 5A:
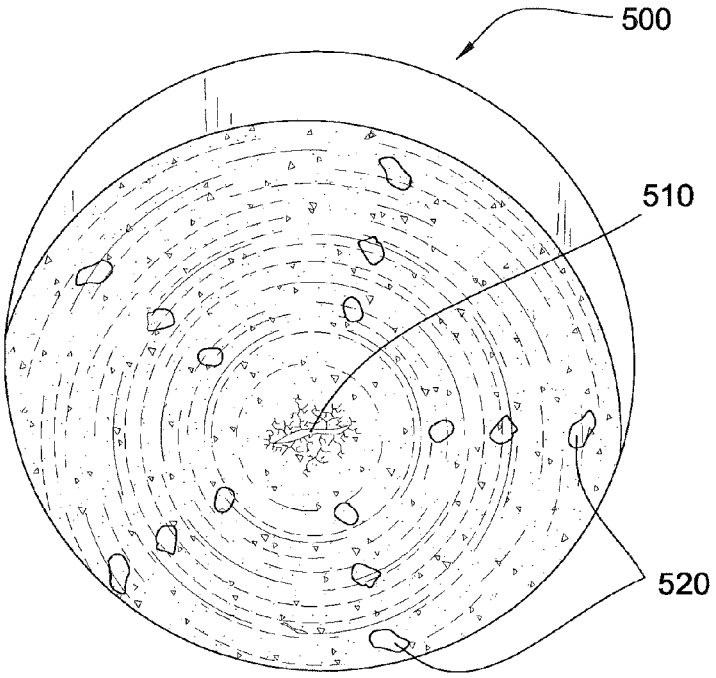
FIG. 5*a* is a perspective diagram of an embodiment of a borehole.

FIG. 5*a* shows a bottom of a borehole 500 of a sample formation drilled by a drill bit 104 of the present invention. A central area comprises fractures 510 created by the indenting member. Craters 520 form where blade elements on the blades 210 strike the formation upon failure of the rock under the indenting member. The cracks ahead of the cutting elements propagate and create chips that are removed by the cutting elements and the flow of drilling fluid.

Figure 5B:
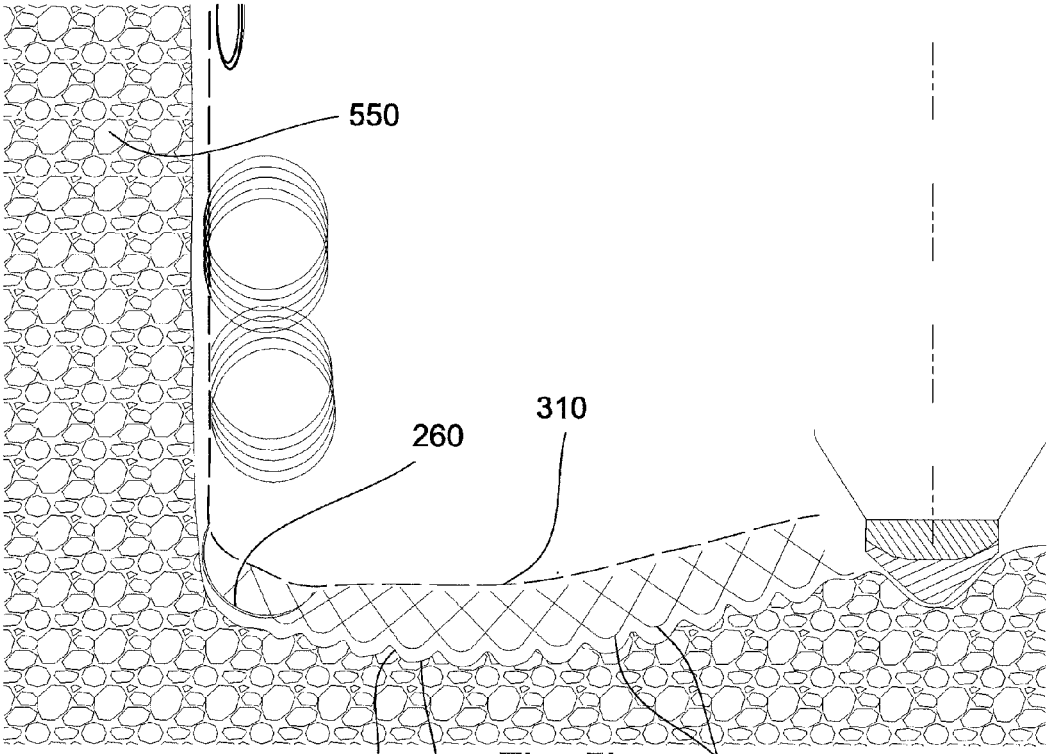
FIG. 5*b* is an orthogonal diagram of another embodiment of a blade cutting element profile.

Referring now to FIG. 5*b*, a pattern made by the cutting elements in the formation is disclosed. The pointed cutting elements 240 may induce intermittent fractures in the formation 550 while the drill bit 104 is in operation. Such fractures may lead to the breaking of chips while drilling down hole. A cutting profile of the first shearing cutters 260 is more exposed to the formation 550 than the cutting profile of the plurality of pointed cutting elements 240. The first shearing cutters 260 may deform the formation 550 by taking chips off the formation 550 or in an abrasive manner. Grooves 530 and ridges 540 are formed in the formation 550 as the drill bit 104 penetrates further deep into the formation 550. A groove created by the first shearing cutters 260 in the formation is wider than grooves created by pointed cutting elements 240 in the formation. Wider grooves minimize the wobbling of the cutting elements, thereby keeping the drill bit 104 stable during operation.

Figure 6A:
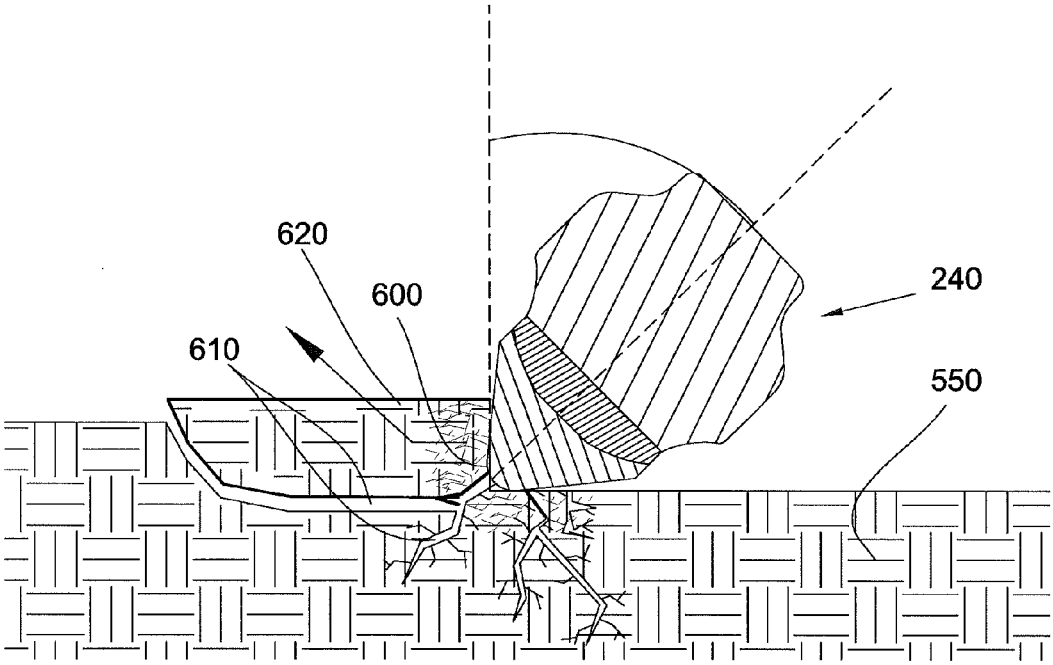
FIG. 6*a* is a cross-sectional diagram of an embodiment of a cutting element degrading a formation.

FIG. 6*a* discloses an embodiment of a pointed cutting element 240 engaging a formation 550. The pointed cutting element 240 comprises an apex 600. The apex 600 comprises a curvature that is sharp enough to easily penetrate the formation 550, but is still blunt enough to fail the formation 550 in compression ahead of itself. As the cutting element 240 advances into the formation 550, apex 600 fails the formation 550 ahead of the cutter 240 and peripherally to the sides of the cutter 240, creating fractures 610. Fractures 610 may continue to propagate as the cutter 240 advances into the formation 550, eventually reaching the surface of the formation 550 allowing large chips 620 to break away from the formation 550. The rate of penetration of pointed cutting elements 240 is higher than that of the shearing cutters 250. Preferably, the curvature has a 0.050 to 0.120 radius of curvature. However, similar curves that are elliptical, conic, or non-conic.

Figure 6B:
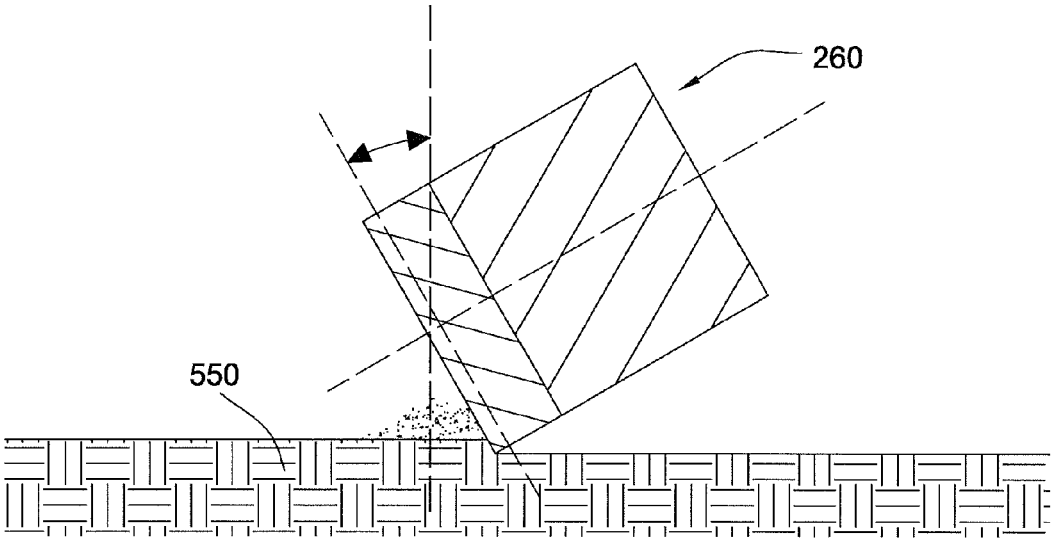
FIG. 6*b* is a cross-sectional diagram on another embodiment of a cutting element degrading a formation.

FIG. 6*b* discloses an embodiment of a shearing cutter 260 engaging a formation 550. The shearing cutters 260 drag against the formation 550 and shear off thin layers of formation 550. The shearing cutters 260 require more energy to cut through the formation 550 than the pointed cutting elements.

Figure 7:
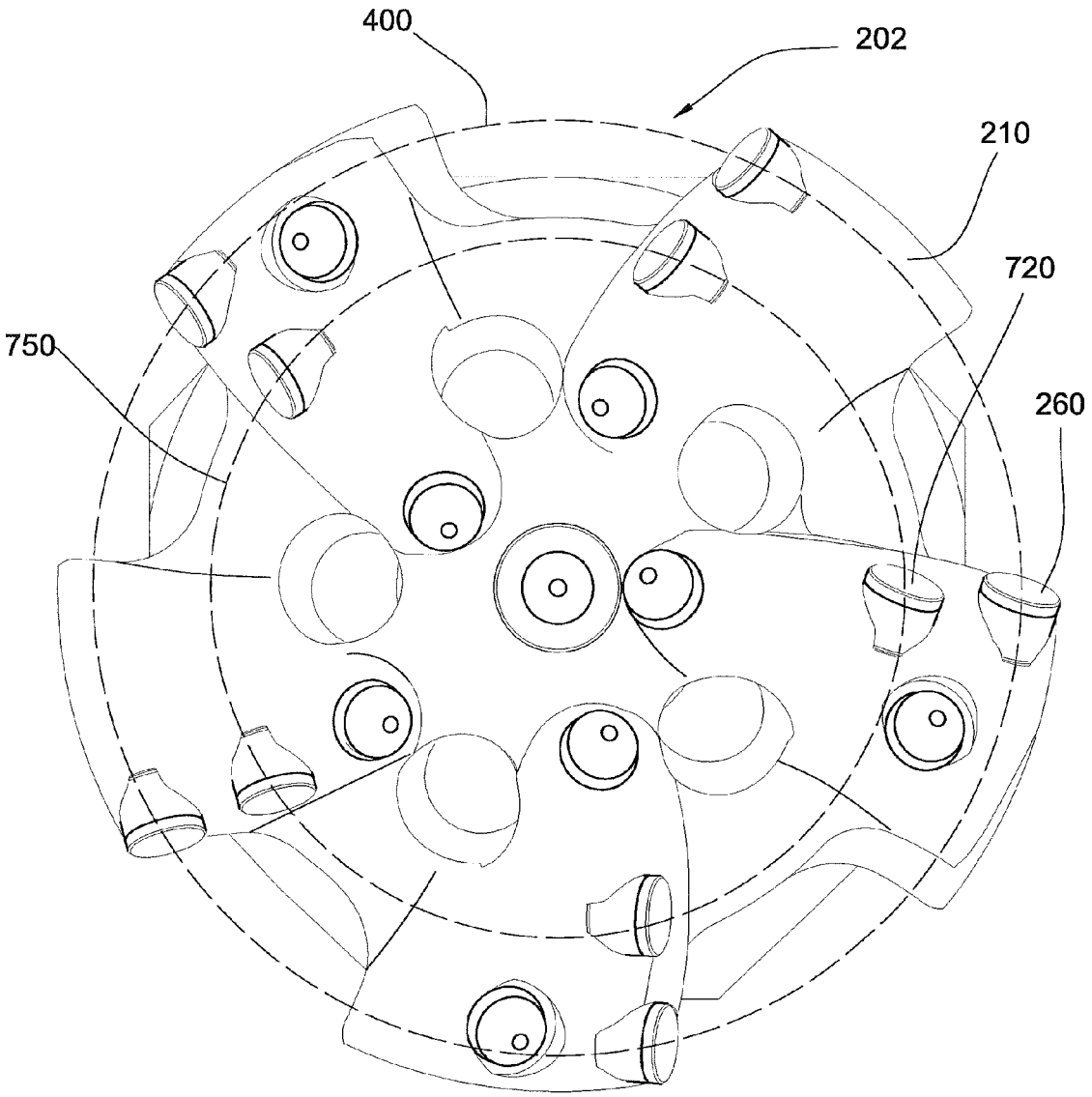
FIG. 7 is an orthogonal diagram of another embodiment of a working surface of a rotary drag bit.

Referring to FIG. 7, an orthogonal diagram of an embodiment of a working surface 202 of a drill bit 104. Each blade 210 comprises a first shearing cutter 260 and a second shearing cutter 720. The first shearing cutter 260 is positioned proximate to the periphery of the working surface 202 while the second shearing cutter 720 is positioned intermediate the periphery and the center of the working surface 202. The first shearing cutter 260 and second shearing cutter 720 in each blade 210 track the first shearing cutters 260 and the second shearing cutters 720 in other blades 210 along a common circular cutting paths 400, 750 respectively.

Figure 8:
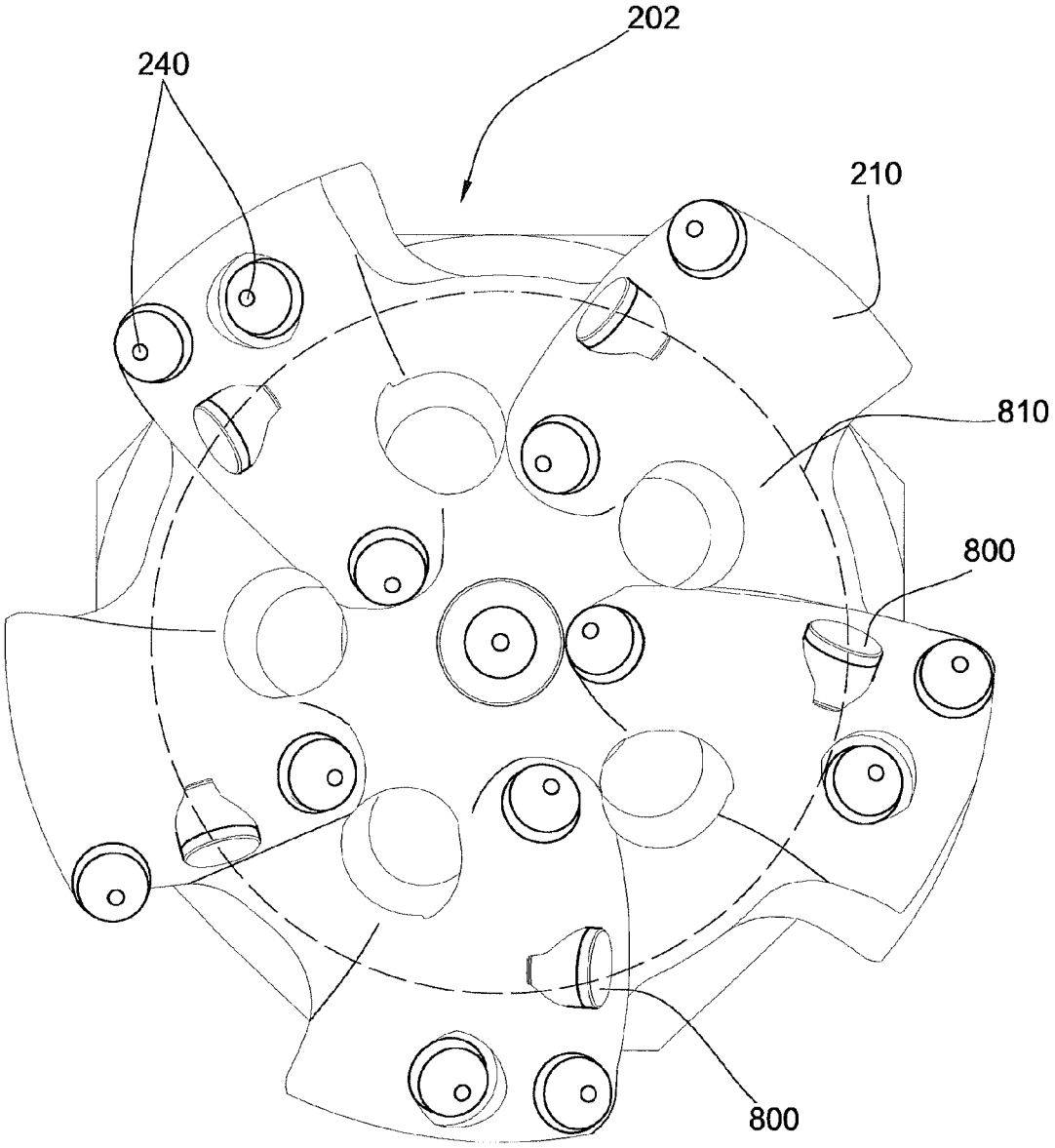
FIG. 8 is an orthogonal diagram of another embodiment of a working surface of a rotary drag bit.

FIG. 8 discloses shearing cutters 800 positioned intermediate the periphery and the center of the working surface 202. The shearing cutter 800 on a blade 210 tracks the shearing cutters 800 on other blades 210 along a common circular cutting path 810.

Figure 9:
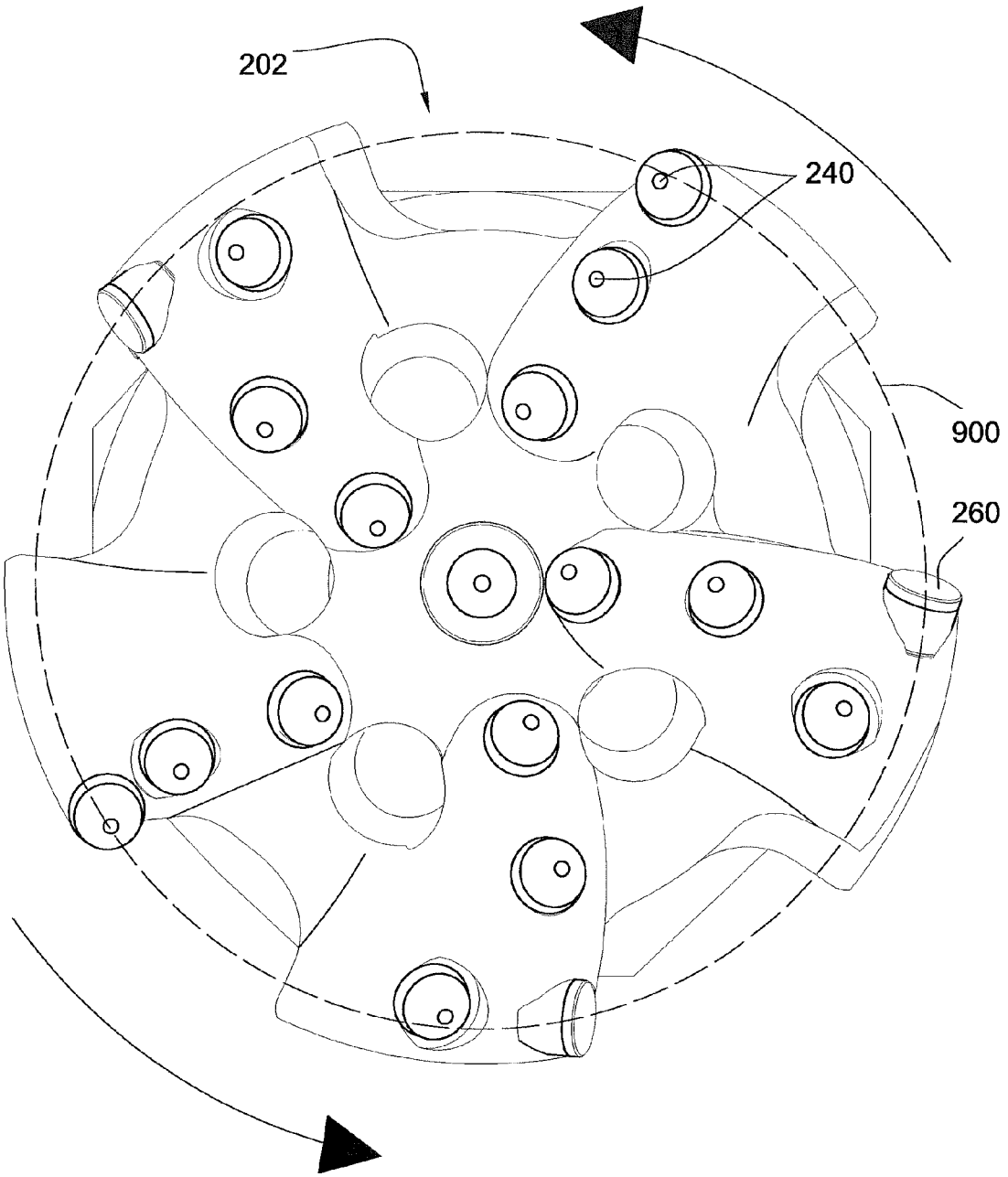
FIG. 9 is an orthogonal diagram of another embodiment of a working surface of a rotary drag bit.

FIG. 9 discloses both first shearing cutters 260 and pointed cutting elements 240 at the periphery of the bit's working surface 202. In some embodiments, the pointed cutting elements 240 and the first shearing cutters 260 are positioned in an alternating pattern. The shearing cutters positioned at the periphery track each other along a common circular cutting path 900. Preferably, at least three shearing cutters on separate blades track each other at the bit's periphery.

Whereas the present invention has been described in particular relation to the drawings attached hereto, it should be understood that other and further modifications apart from those shown or suggested herein, may be made within the scope and spirit of the present invention.

What is claimed is:

1. A fixed bladed drill bit, comprising:

a working face comprising a plurality of blades converging at a center of the working face and diverging towards a gauge of the bit;

each blade comprising a leading face and a trailing face;

at least one row of cutting elements disposed on at least one of the plurality of blades proximate to the leading face of the blade, where the row of cutting elements comprises:

at least one pointed cutting element having a cutting end with a rounded apex; and at least one shearing cutter, the at least one shearing cutter comprising a first shearing cutter positioned proximate to a periphery of the working face, and wherein at least a portion of the first shearing cutter is aligned behind a first pointed cutting element proximate to the leading face of another of the plurality of blades in rotated profile.

2. The bit of claim 1, wherein the cutting end has a conical shape.

3. The bit of claim 1, wherein the periphery of the working face on each of the plurality of blades comprises either a shearing cutter or a pointed cutting element.

4. The bit of claim 1, wherein the at least one shearing cutter further includes an intermediate shearing cutter positioned intermediate the periphery of the working face and the center of the working face on the blade.

5. The bit of claim 1, wherein the at least one shearing cutter on one of the plurality of blades tracks at least one shearing cutter on at least one other of the plurality of blades along common circular cutting paths.

6. The bit of claim 1, wherein the first shearing cutter has an exposure height from the blade greater than an exposure height of the at least one pointed cutting element.

7. The bit of claim 1, wherein the at least one pointed cutting element is aligned such that a portion of each pointed cutting element overlaps a portion of an adjacent pointed cutting element in rotated profile.

8. The bit of claim 1, wherein the first shearing cutter and the at least one pointed cutting element are in a linear profile on each blade in a rotated profile view.

9. The bit of claim 1, wherein the first shearing cutter and the at least one pointed cutting element are in a curved profile on each blade in a rotated profile view.

10. The bit of claim 1, wherein each of the at least one pointed cutting element is exposed at the same height above the blade profile.

11. The bit of claim 1, wherein the at least one pointed cutting element is exposed at varying angles on the working face.

12. The bit of claim 1, wherein the at least one pointed cutting element comprises a superhard material bonded to a cemented metal carbide substrate at a non-planar interface.

13. The bit of claim 1, further comprising a plurality of gauge shearing cutters disposed on the plurality of blades along the gauge of the bit.

14. A fixed bladed drill bit, comprising:

a working face comprising:

a plurality of blades converging at a center of the working face and diverging towards a gauge of the bit, each blade comprising a leading face and a trailing face;

a plurality of cutting elements disposed on the plurality of blades, at least two of the plurality of cutting elements positioned in a first row along a first blade proximate the leading face of the first blade, the first row comprising:

at least one pointed cutting element having tapered sides and a cutting end with a rounded apex, the at least one pointed cutting element including a first pointed cutting element positioned proximate to a periphery of the working face; and at least one shearing cutter, where the at least one shearing cutter is radially inward the first pointed cutting element; and a second row of at least two of the plurality of cutting elements positioned along a second blade proximate the leading face of the second blade, the second row comprising at least one pointed cutting element and a first shearing cutter positioned proximate to the periphery of the working face, wherein the first shearing cutter and the first pointed cutting element share a common cutting path.

15. The bit of claim 14, wherein the cutting end has a conical shape.

16. The bit of claim 14, wherein the at least one pointed cutting element comprises a superhard material bonded to a cemented metal carbide substrate at a non-planar interface.

17. The bit of claim 14, further comprising a plurality of gauge shearing cutters disposed on the plurality of blades along the gauge of the bit.

* * * * *